US007703748B2

(12) United States Patent
Foley

(10) Patent No.: US 7,703,748 B2
(45) Date of Patent: Apr. 27, 2010

(54) FASTENER EXTRACTION TOOL

(75) Inventor: Michael J. Foley, Hailey, ID (US)

(73) Assignee: Nail Jack Tools, Inc., Hailey, ID (US)

( * ) Notice: Subject to any disclaimer, the term of this patent is extended or adjusted under 35 U.S.C. 154(b) by 0 days.

(21) Appl. No.: 11/972,742

(22) Filed: Jan. 11, 2008

(65) Prior Publication Data

US 2009/0126539 A1 May 21, 2009

Related U.S. Application Data

(60) Provisional application No. 61/003,834, filed on Nov. 20, 2007.

(51) Int. Cl.
*B25C 11/00* (2006.01)

(52) U.S. Cl. ..... 254/23; 254/28; 81/418

(58) Field of Classification Search ..... 254/18, 254/21, 22, 23, 28; 81/418, 415
See application file for complete search history.

(56) References Cited

U.S. PATENT DOCUMENTS

| | | | | | |
|---|---|---|---|---|---|
| 143,496 | A | | 10/1873 | Capewell | |
| 600,082 | A | | 3/1898 | Krutsch | |
| 715,915 | A | * | 12/1902 | White | 140/123 |
| 795,876 | A | | 8/1905 | Willhide | |
| RE12,458 | E | | 2/1906 | Baggett | |
| 840,580 | A | | 1/1907 | McMillan | |
| 885,816 | A | | 4/1908 | Weyeneth | |
| 929,821 | A | | 8/1909 | Bonner | |
| 1,293,966 | A | | 2/1919 | Spinger | |
| 1,382,109 | A | | 6/1921 | Matsler | |
| 1,495,028 | A | | 6/1924 | Mitchell | |
| 1,532,147 | A | | 4/1925 | MacPherson | |
| 1,644,352 | A | | 10/1927 | Perrin | |
| 1,949,335 | A | | 2/1934 | Settles | |
| 1,989,918 | A | * | 2/1935 | Drypolcher | 254/28 |
| 2,313,530 | A | | 3/1943 | Feigion | |
| 2,336,961 | A | | 12/1943 | Russell | |
| 2,462,250 | A | | 2/1949 | Andrews | |

(Continued)

FOREIGN PATENT DOCUMENTS

JP 06-066973 U 9/1994

(Continued)

OTHER PUBLICATIONS

Raymond P. Fredrich,Nail Pullers, 2006, pp. 1-118, Authorhouse, Bloomington, IN.
PCT Search Report; PCT/US2008/083972; May 28, 2009, 18 pages.

*Primary Examiner*—Lee D Wilson
(74) *Attorney, Agent, or Firm*—Brown & Michaels, PC

(57) ABSTRACT

The hand tool is used to extract a fastener from a material. The hand tool has a head with two pivotally joined halves including at least one pair of gripping jaws. The tool head preferably includes tips that may be used to dig beneath a fastener head that is flush with or set below a surface. The tool includes a pair of handles operable to close the gripping jaws. The handles are preferably offset above the plane of the tool head such that they operate as a lever in cooperation with a fulcrum on the bottom of the tool head to extract the fastener.

21 Claims, 7 Drawing Sheets

U.S. PATENT DOCUMENTS

| | | | | |
|---|---|---|---|---|
| 2,501,500 | A | 3/1950 | De Armond | |
| 2,578,230 | A | 12/1951 | Davis | |
| 3,150,666 | A | 9/1964 | Averbach | |
| 4,953,248 | A | 9/1990 | Trombetta | |
| 5,150,488 | A | 9/1992 | Yuan et al. | |
| D356,238 | S | 3/1995 | Moore et al. | |
| 5,575,029 | A | 11/1996 | Simpson | |
| 5,611,519 | A | 3/1997 | Garcia | |
| 5,636,398 | A | 6/1997 | Fike | |
| 6,088,920 | A | 7/2000 | Schmick | |
| 6,105,935 | A | 8/2000 | Wagner | |
| 6,202,517 | B1 | 3/2001 | Dolan | |
| 6,223,373 | B1 | 5/2001 | Yeh | |
| 6,314,599 | B1 | 11/2001 | Hay | |
| 6,701,560 | B2 | 3/2004 | Foley | |
| 6,733,001 | B2 | 5/2004 | Wagner | |
| 6,772,765 | B2 | 8/2004 | Scheller et al. | |
| 6,826,831 | B2 | 12/2004 | Crawley | |
| 7,249,752 | B1 * | 7/2007 | Foley | 254/23 |
| 2009/0126539 | A1 * | 5/2009 | Foley | 81/418 |

FOREIGN PATENT DOCUMENTS

| | | | |
|---|---|---|---|
| JP | 07-000673 | U | 1/1995 |
| JP | 10-156755 | A | 6/1998 |
| JP | 2001-260040 | A | 9/2001 |
| JP | 2003-200358 | A | 7/2003 |
| KR | 20-1993-0017899 | U | 8/1993 |

* cited by examiner

FASTENER EXTRACTION TOOL

REFERENCE TO RELATED APPLICATIONS

This application claims one or more inventions which were disclosed in Provisional Application No. 61/003,834, filed Nov. 20, 2007, entitled "FASTENER EXTRACTION TOOL". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of hand tools. More particularly, the invention pertains to a hand tool having operable gripping jaws for extracting fasteners embedded in a material.

2. Description of Related Art

Fasteners, such as nails, brads, and staples, are commonly used to fasten objects to workpieces such as wood. A hammer, as is used to drive nails and brads, typically includes a claw for removing nails. Unfortunately, the claws of hammers do not grip fasteners with small heads such as finish nails and brads well. Furthermore, the heads of nails and brads are typically driven slightly below the surface of the fastened workpiece so the fasteners are less visible. In order to extract such an embedded fastener using the claws of a hammer, the fastener head must first be raised above the surface of the workpiece in which the fastener is embedded. Furthermore, powered nail guns are increasingly replacing hammers, and often drive nail heads below the workpiece surface, even for common nails. Nail guns typically have no provision for removing nails. Similarly, the use of staples in place of nails is increasing, and stapling tools also lack a means for removing fasteners.

Because of the above considerations there is a need for a dedicated tool to remove embedded fasteners. In addition to the claw found on common hammers, tools have been developed specifically for the purpose of removing fasteners, such as nails, brads, and staples, from workpieces.

A different type of nail extraction tool is typified by the apparatus disclosed in U.S. Pat. No. 143,496 to Capewell. This tool is oriented vertically above the fastener to be removed, and has hinged pincer-like jaws that can be driven under the fastener by means of a slide hammer integral to the vertical handle of the tool. Typically, one of the jaws has an extension that acts as a fulcrum for levering a gripped fastener from the workpiece. This class of tool is best suited to rough work where the appearance of the material is unimportant, such as the disassembly of crates or framing, since the pincers tend to cause significant damage to the surface of the workpiece around the fastener head, and the small area of the fulcrum generally causes damage to the surface against which it is applied. A related class of tool is disclosed in U.S. Pat. No. 6,733,001 to Wagner. This tool is also oriented vertically above a fastener and includes moveable jaws for grasping the fastener and a fulcrum surface contiguous with one jaw. To apply the Wagner tool, the fastener must be partially emergent from the workpiece since the tool provides no means for digging under a fastener head that is flush with or embedded below the surface of the workpiece. This represents a significant inconvenience, since in many instances a user is forced to apply two separate tools to complete the job: one tool to pry the fastener head proud of the surface, and then the Wagner tool to complete the removal. This represents a significant inconvenience and inevitably slows the progress of the work at hand.

It would be beneficial to have a hand tool better adapted to extract a fastener from a workpiece. Such a hand tool should be capable of both easily accessing a fastener head flush with or below a surface and effectively prying the entire fastener from the workpiece without causing significant damage to the surface.

SUMMARY OF THE INVENTION

A hand tool is disclosed for extracting a fastener from a material. The hand tool has a head with two pivotally joined halves including at least one pair of gripping jaws. The tool head preferably includes tips that may be used to dig beneath a fastener head that is flush with or set below a surface. The tool includes a pair of handles operable to close the gripping jaws. The handles are preferably offset above the plane of the tool head such that they operate as a lever in cooperation with a fulcrum on the bottom of the tool head to extract the fastener.

Other features and advantages of the present invention will become apparent from the following more detailed description, taken in conjunction with the accompanying drawings, which illustrate, by way of example, the principles of the invention.

DETAILED DESCRIPTION OF THE INVENTION

A tool closely related to the present invention is disclosed in commonly-owned U.S. Pat. No. 7,249,752, issued Jul. 31, 2007 to Foley, the disclosure of which is hereby incorporated herein by reference.

Figure 1A:
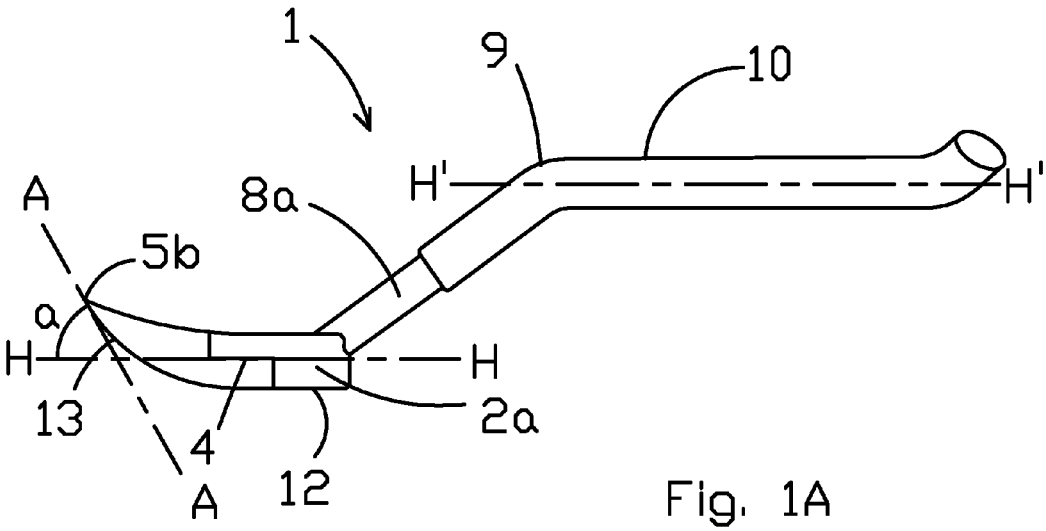
FIG. 1A shows a side view of a nail extraction tool in an open position in an embodiment of the present invention.

The following terms as used herein are defined relative to the tool or the workpiece. With reference to the tool, as shown in FIG. 1A, forward is defined as toward the left, rearward is defined as toward the right, upward is defined as toward the top of the page, and downward is defined as toward the bottom of the page. With reference to a workpiece, upward is defined as away from the surface of the workpiece where the fastener is lodged and downward is defined as toward the surface of the workpiece where the fastener is lodged.

FIGS. 1A through 1F depict a first embodiment of a fastener extraction tool 1 of the present invention. The fastener extraction tool 1 includes a tool head 2 which has two halves 2*a*, 2*b*. The halves 2*a*, 2*b* overlap in a central region where they are pivotally joined by a pivot 3. As can be seen in FIG. 1A, the overlap of the halves 2*a*, 2*b* at an interface 4 defines a substantially horizontal rotation plane H-H. Moving the halves 2*a*, 2*b* about the pivot 3 causes the tool head halves 2*a*, 2*b* to rotate relative to one another in the plane H-H shown in FIGS. 1A and 1C. Each half 2*a*, 2*b* of the tool head 2 has a portion extending forward of the pivot 3. The portions of the tool head halves 2*a*, 2*b* that are forward of the pivot 3 are tapered in at least one dimension such that the forward tips 5*a*, 5*b* of the tool head form a sharp implement that may be used to dig beneath the head of a fastener to extract it from the surface of a workpiece in which it is embedded.

The tool head 2 includes one or more pairs of gripping jaws for grasping and pulling fasteners. These gripping jaws are preferably formed from inward facing surfaces of tool head halves 2*a*, 2*b*. In the specific embodiment of the tool depicted in FIGS. 1A through 1F, there are two such pairs of jaws. A first pair of jaws 6 is located forward of the pivot 3 and includes two faces 6*a*, 6*b*. A second pair of jaws 7 is located rearward of the pivot 3 and includes two faces 7*a*, 7*b*. When the handles of the tool are brought together, the faces 6*a*, 6*b* and 7*a*, 7*b* of each pair of jaws come together along a longitudinal axis extending from the center front of the tool head 2 through the pivot 3 to the center rear of the tool head 2. In alternate embodiments, the fastener extraction tool may include only the forward pair of gripping jaws, only the rearward pair of gripping jaws, or more than two sets of gripping jaws.

The gripping jaws preferably include opposing gripping surfaces, which may be of any texture or material that allows the jaws to grip a fastener without slipping when held together by the user. Preferably, one or both of the pairs of jaws 6, 7 include a textured surface to better grasp a fastener. In the embodiment depicted in FIGS. 1C through 1F, this textured surface consists of grooves 11 oriented longitudinally along both faces of the pairs of jaws 6, 7. The grooves may have any suitable profile but are particularly effective when triangular in cross section as shown in FIGS. 1C through 1F. The grooves on each jaw may be arranged to mesh or to interfere when the jaws are closed.

The gripping jaws 6, 7 of the fastener extraction tool 1 do not primarily include cutting surfaces, such as those found in nippers and wire cutters, which may be of superficially similar appearance. Such cutting surfaces interfere with the goal of extracting a fastener. For instance, if one attempts to grip a fastener shaft with such cutting jaws and applies a force sufficient to facilitate its extraction, the blades of the tool simply cut through the fastener before it is fully extracted. The jaws of the present tool preferably have a sufficiently broad surface to prevent this undesirable cutting through of a fastener. Nonetheless, in alternate embodiments, to increase the possible uses of the tool, a secondary cutting jaw may be included, or a portion of one or more pair of jaws may be provided with a sharp portion for cutting.

The fastener extraction tool 1 has two handles 8*a*, 8*b* extending rearward from the tool head 2, each handle extending from one half of the tool head 2*a*, 2*b* respectively. Moving the handles 8*a* and 8*b* together or apart causes the halves 2*a*, 2*b* of the tool head 2 to rotate about the pivot 3 and the pairs of gripping jaws 6, 7 to close and open. Preferably, at least a portion of the handles 8*a*, 8*b* is offset above the tool head. This portion includes a gripping portion for the user to apply a gripping pressure to the handles, which is transferred to the jaws for gripping the fastener. This offset allows leverage to be applied by exerting a downward force on the handles. As shown in FIG. 1A, the handles are preferably offset in a plane H'-H', which is substantially parallel and located significantly above the plane H-H of the pivot. The handles may optionally include a surface coating 10 as shown in the figures. This surface coating is preferably a resilient material such as polymeric material that provides a surer grip for the user and makes the tool more comfortable to use. In addition, the handles are preferably sized and spaced to allow a comfortable grip of the tool by a user. In the depicted embodiments, the tool is configured for a single-handed grip, although in alternate embodiments of the present invention, such as those intended for heavier work, the handles may be sized and spaced for comfortable two-handed operation.

Figure 1B:
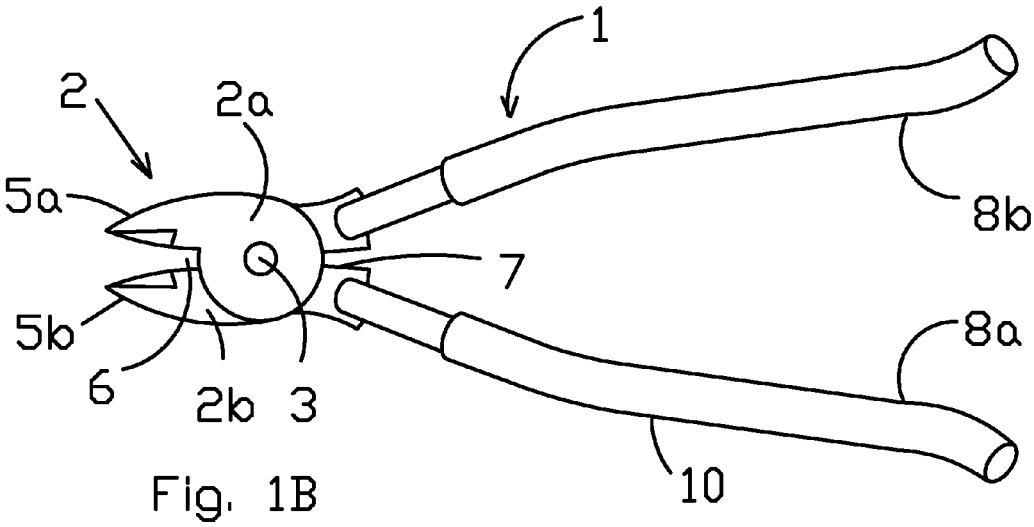
FIG. 1B shows a top view of the embodiment of FIG. 1A.
Figure 1C:
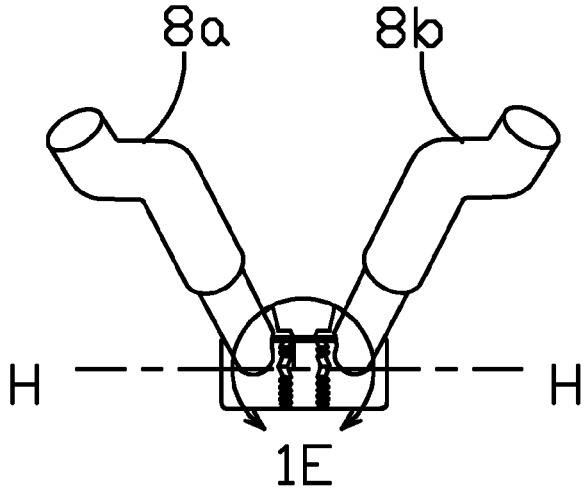
FIG. 1C shows a rear view of the embodiment of FIG. 1A.
Figure 1D:
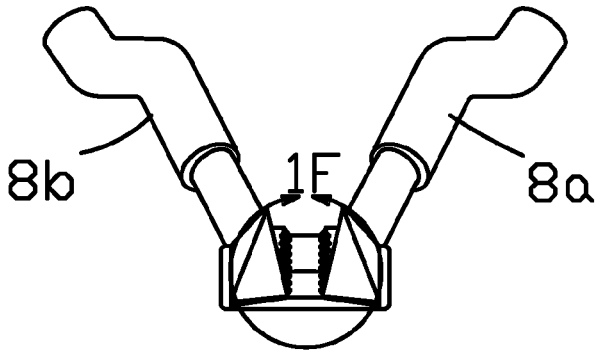
FIG. 1D shows a front view of the embodiment of FIG. 1A.
Figure 1E:
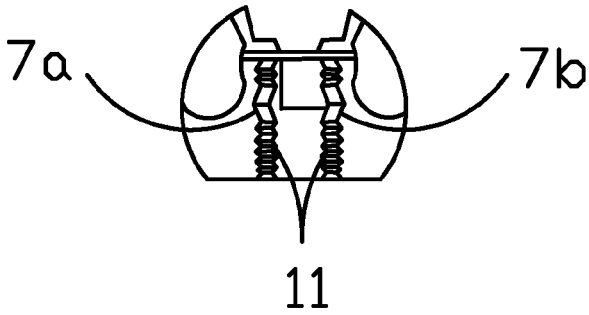
FIG. 1E shows a detailed view of the circle region 1E of FIG. 1C.
Figure 1F:
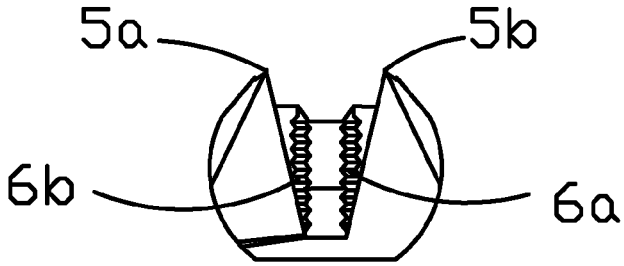
FIG. 1F shows a detailed view of the circle region 1F of FIG. 1D.

In the specific embodiment depicted in FIGS. 1A and 1B, the handles 8*a*, 8*b* extend rearward from the tool head 2 at an upward angle to a bend 9 beyond which the handles extend rearward in a direction substantially parallel to the plane H-H. It is to be understood that other shapes and arrangements of the handles may be used within the spirit of the present invention. The handles may extend upward for their entire length or may be curved or otherwise differently shaped than the depicted embodiments.

Figure 2:
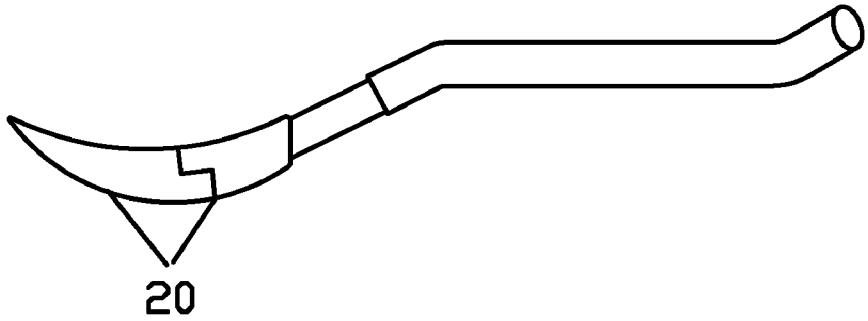
FIG. 2 shows a nail extraction tool with a spoon-shaped profile in an embodiment of the present invention.

Preferably, a fastener extraction tool of the present invention has a longitudinally curved profile sloping upward toward either the front tip or the back end of the tool head on at least a portion of the bottom surface of the tool. This longitudinal curve aids in applying leverage to extract a fastener. FIG. 1A shows a plane A-A tangent to the underside of the forward jaws near the tip 5*b*. This plane A-A preferably forms an angle a with plane H-H, where angle a is preferably at least 45°. When the curved portion of the tool head bottom is used as the fulcrum to apply this leverage, it reduces the chance that the surface from which the fastener is being removed becomes damaged, since in such an arrangement, the fulcrum point of the tool moves in relation to the surface of the workpiece as the tool handles are moved upward or downward. This feature lowers the chance that a damaging force is applied at a particular point on the surface. The curve on the bottom of the tool head may encompass the entire length of the tool head, or it may extend for only a portion of the length. In the embodiment depicted in FIG. 1A, the tool head 2 includes a flat portion 12 rearward of the pivot, and only the front portion 13 of the profile is longitudinally curved. In the embodiment depicted in FIG. 2, the bottom 20 of the tool head is curved along its entire length, creating a spoon-like longitudinal profile. It is to be understood that the direction and extent of the curvature on the bottom of the tool head may be modified without departing from the spirit of the present invention.

Figure 3:
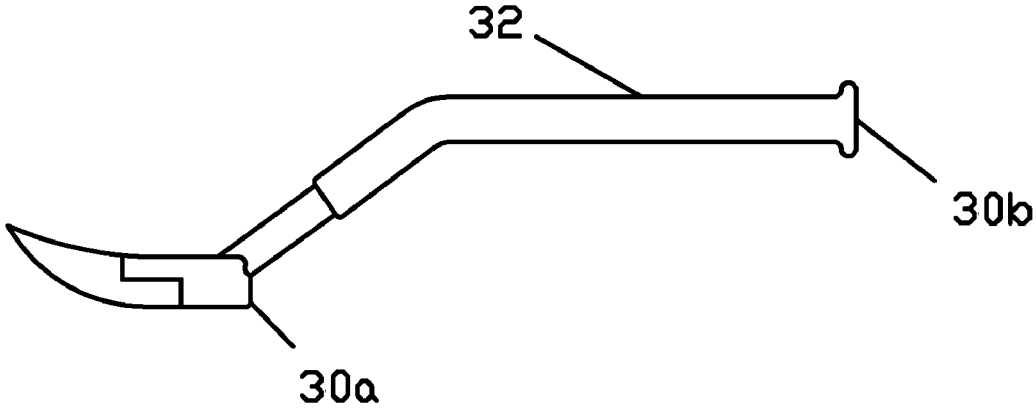
FIG. 3 shows a nail extraction tool with striking surfaces in an embodiment of the present invention.

Another preferred feature of a fastener extraction tool of the present invention is at least one striking surface designed to receive a blow from a hammer or similar tool. This feature allows a user to apply additional force to the tool to aid in extracting a fastener. In the embodiment shown in FIG. 3, a striking surface 30*a* is formed at the back of the tool head and another striking surface 30*b* is formed at the free end of one or both of the handles 32. The striking surface 30*a* at the back of the tool head is preferred in that it allows the user to drive the tool with a hammer or other striking tool with one hand in the direction of the forward tips while holding the handles with the other hand. With this arrangement, a hammer blow effectively applies the force necessary to drive the sharp tips of the tool head into a material, thereby allowing them to dig beneath and extract the head of an embedded fastener. The striking surface is particularly effective in combination with the claw-shaped portion discussed below in digging beneath a fastener head. The striking surface may have a bull's eye or similar pattern to aid the user in aiming. The striking surface may also have a non-metallic coating to reduce the noise of a metal hammer strike and to reduce sliding of the hammer in a glancing blow to the striking surface.

Figure 4:
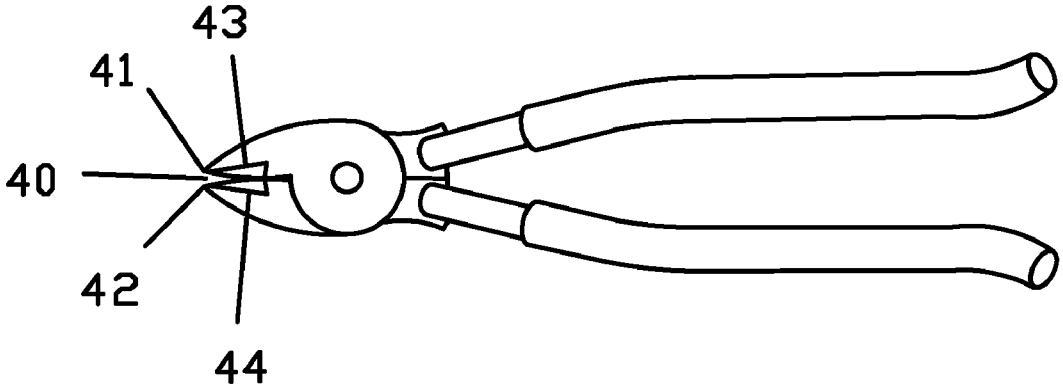
FIG. 4 shows a nail extraction tool with splayed tips in an embodiment of the present invention.

A number of additional features may be included on a fastener extraction tool of the present invention. Each of these features may be used in combination with any of the other features. The tool may include a claw-shaped portion at the forward end of the tool head. FIG. 4 illustrates a particular embodiment of this feature. The forward-most portion of each jaw is splayed outward slightly such that that the forward-portion of the jaw does not meet 40 when the gripping portion is closed as shown in FIG. 4. This splayed arrangement of the jaw tips 41, 42, in combination with the tapered shape of the forward jaws creates a feature similar to the claw on a common hammer or a tack puller. This claw-like feature allows a user to access and pry an embedded fastener upward so that it may be effectively grasped and removed by the gripping jaws. Preferably, the splayed portion of each jaw also includes an inward bevel 43, 44, such that the inward facing surface of the splayed portion has a narrow edge that may be slid under a fastener head. As shown in FIG. 4, this bevel may be inclined forward so that the edge narrows toward the tip of the tool, this arrangement tending to raise the fastener head as the claw is worked forward underneath it. Additionally, the splayed portions preferably taper to a shape that facilitates digging into wood or a similar material. In the embodiment of the tool depicted in FIG. 4, the tips of the claw taper to sharp points that readily penetrate wood or similar materials. In alternate embodiments, the tips may have other shapes, including, but not limited to, chisel-like ends, to perform a similar function.

Figure 5:
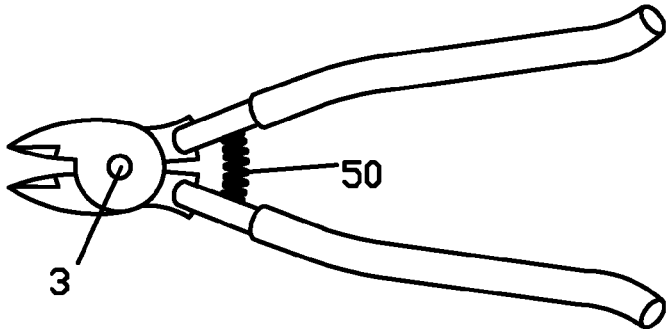
FIG. 5 shows a nail extraction tool with a spring system in an embodiment of the present invention.

A second feature that may be included on a fastener extraction tool of the present invention is a biasing element that biases the jaws to an open position. As shown in FIG. 5, a spring system 50 is disposed between the handles rearward of the pivot 3. Many other arrangements are known in the art for biasing the handles of pliers and similar tools. These arrangements include various types of springs disposed in a variety of ways. It is to be understood that any such mechanism may be adapted to the present tool without departing from the spirit of the present invention.

Figure 6:
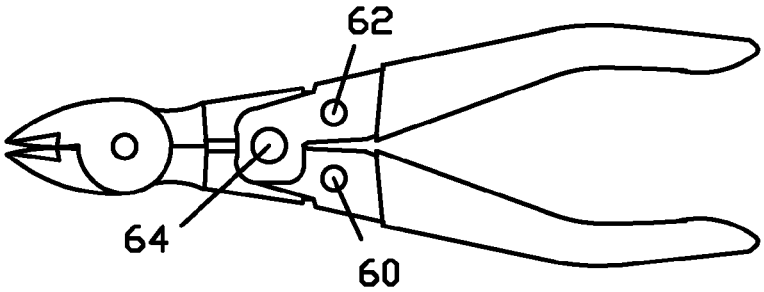
FIG. 6 shows a nail extraction tool with compound pivots in an embodiment of the present invention.

A third feature that may be included on a fastener extraction tool of the present invention is a compound leverage action between the tool head and the handles. Hand tools designed to apply heavy gripping or cutting forces often include a multi-part pivot assembly between their handles and the tool head, which multiplies a force applied to the handles of the tool. The embodiment of the present invention depicted in FIG. 6 shows one such compound leverage mechanism. In this embodiment, each half of the tool head is pivotally linked to one of the handles at a pivot 60, 62. The handles are pivotally linked to each other at a third pivot point 64, located forward of the first two pivots 60, 62. With the compound handles, moving the handles relative to each other through a given angle results in a smaller angular rotation of the tool head halves than with simple handles, but the force transmitted is correspondingly increased. Other compound leverage arrangements for hand tools such as sheet metal shears, bolt cutters, locking pliers, and the like are well known in the art, and it is to be understood that any such mechanism may be incorporated into the present invention.

Figure 7:
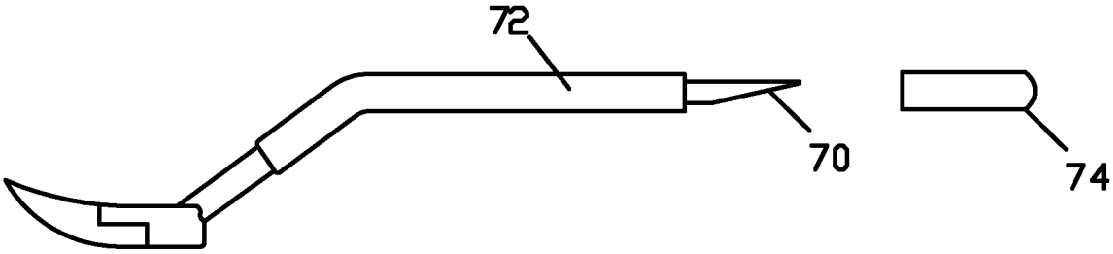
FIG. 7 shows a nail extraction tool with a chisel handle in an embodiment of the present invention.

A fourth feature that may be included on a fastener extraction tool of the present invention is a flat chisel-type end to at least one of the handles. FIG. 7 shows a chisel bar 70 at a terminal end of a handle 72. The chisel bar 70 is preferably formed integral with the handle 70. When the user is using the head of the tool, the chisel bar 70 is preferably covered by a cap 74 to prevent injury to the user. The cap may be made of the same material as the handle grips or of a harder material to prevent damage to the cap by the chisel bar. Chisel bars 70 may be located either on both handles or on just one handle and are preferably used to pry boards or other large building materials apart.

Figure 8A:
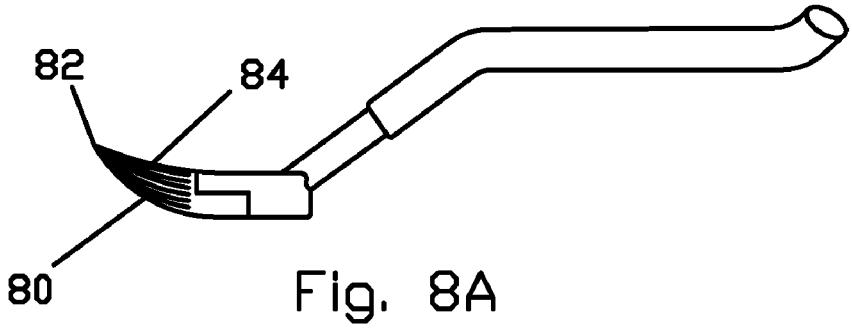
FIG. 8A shows a cut away side view of a nail extraction tool with a gripping surface extending to the tip in an embodiment of the present invention.
Figure 8B:
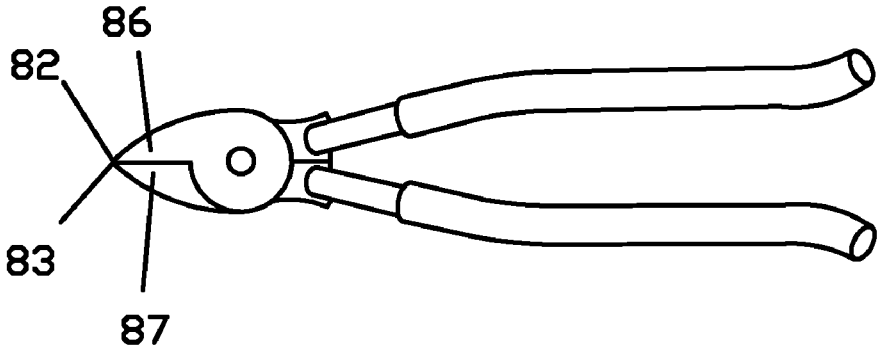
FIG. 8B shows a top view of the embodiment of FIG. 8A.

In an alternate embodiment of the present invention, FIG. 8A shows the gripping surfaces 80 of the front jaws extending all the way to the tips 82 of the front jaws. FIG. 8A is a cut-away view showing only half of the tool head. Although the gripping surfaces 80 are shown as having teeth formed of horizontally-oriented grooves 84, any surface topography or coating which provides enough friction or surface roughness to grab a fastener without slipping may be used within the spirit of the present invention. In this embodiment, as shown in FIG. 8B, the tips 82, 83 preferably meet when the jaws are closed, and the tops 86, 87 of the jaws are preferably substantially flat.

A fastener extraction tool of the present invention may be made from a variety of materials as long as they have the required strength and malleability to be produced in the shapes required. Preferably, the tool is made of steel or a similar high strength material. If the tool is intended for service where corrosion is a concern, the tool may be manufactured of corrosion-resistant materials such as stainless steel or bronze. The surfaces of the tool may optionally be treated by plating or by applying decorative or corrosion-resistant coatings or finishes typical of hand tools. The metal from which the tool is manufactured may be hardened or otherwise treated to ensure that the parts have the necessary strength and durability to perform their functions.

A fastener extraction tool of the present invention preferably provides a user with several options to remove fasteners: the best mode of using the tool depends on the type of fastener to be removed, the workpiece in which the fastener is embedded, and the location of the fastener relative to surrounding objects. For a fastener that is flush with or embedded below a surface, a typical first step involves accessing the head or shaft. As noted above, the forward portion of the tool head preferably includes a sharp implement to aid in this process. In use, this sharp implement penetrates the surface of the workpiece adjacent to a fastener head, and the tool is then forced toward the fastener to dig beneath the head of the fastener. If the fastener extraction tool includes the striking surface described above, a hammer may be used to apply additional force to drive the tips of the tool beneath the fastener. The claw-shaped portion at the tip of the forward jaws may also aid in this process, since it eliminates the need for the user to keep the jaws separated to accommodate the shaft of the fastener.

Once the forward tips of the tool head are inserted beneath a fastener head, downward movement of the handles causes movement about a fulcrum point on the bottom of the tool, and an upward force is imparted to the fastener, thereby raising it from the surface of the workpiece. If the fastener is short, this action may be sufficient to completely remove it from the workpiece. In cases where the fastener is longer, an additional step is necessary. To complete the removal of the fastener, the user may reposition the tool and use the gripping jaws of the tool head to firmly grasp the head or shaft of the fastener where it is exposed above the surface of the workpiece. When the forward jaws are used, the handles are forced downward while gripping the fastener to rotate the tool about a fulcrum point on the bottom of the tool head rearward of the front jaws. This action further raises the fastener from the workpiece. For very long nails, this repositioning may be repeated to complete the extraction. If the fastener extraction tool includes a rear pair of jaws as described above, the fastener may be grasped with these jaws instead, in that case, the handles are moved in an upward direction so that the tool pivots about a fulcrum point forward of the rear jaws. The decision as to which pair of jaws to employ in a particular situation may depend on the type of fastener, the available surfaces against which the fulcrum acts, and the amount of space available in which to operate the tool. An assortment of fastener types may be extracted using the methods above, including, but not limited to, nails, staples, brads, tacks, pins and other similar hardware.

Figure 9:
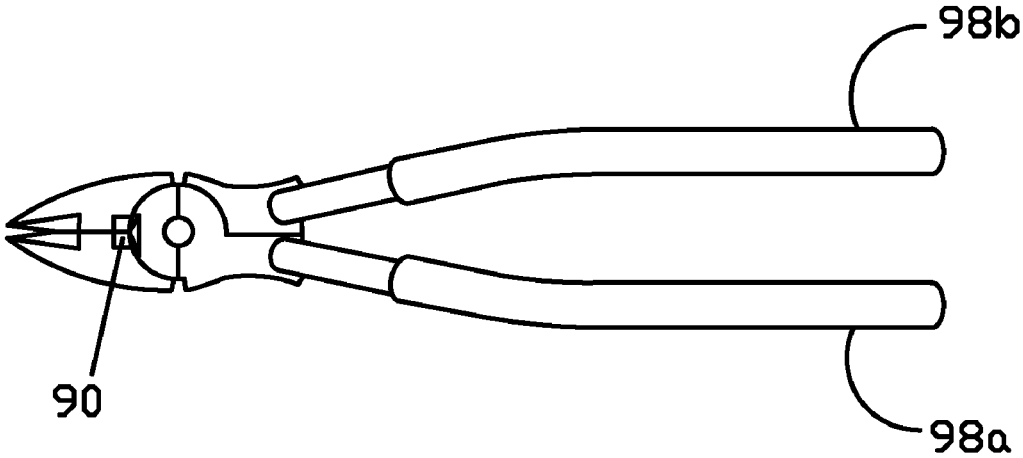
FIG. 9 shows a nail extraction tool with a straight gripping section and a cutter in an embodiment of the present invention.

To increase the usefulness of the tool, a tool of the present invention may include cutter surfaces to allow the tool to cut wire, nails, or other similar materials. The cutter feature is preferably located in at least a portion of one pair of jaws of the tool. The cutter is preferably located in only a portion of the pair of jaws such that the jaws may be used both for gripping without cutting and for cutting depending on the placement of the object in the jaws. Referring to FIG. 9, in one embodiment, the cutter 90 is located in the forward extending portion of the tool head. In another embodiment of the present invention, the cutter is located in the rearward extending portion of the tool head.

Figure 11:
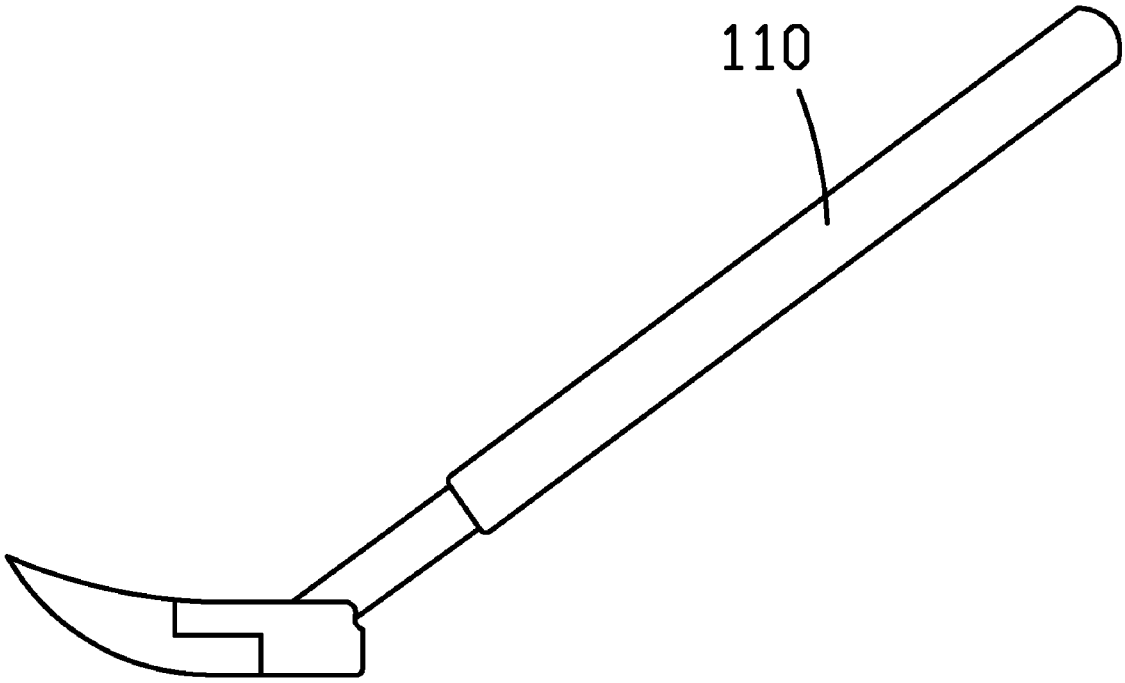
FIG. 11 shows a side view of a nail extraction tool with a straight handle in an embodiment of the present invention.

FIG. 9 also shows handles 98*a*, 98*b* that are substantially straight along the length of the gripping section as an alternative to the curved ends shown in FIG. 1 through FIG. 8. As a second alternative, FIG. 11 shows handles 110 that extend substantially straight from one end to the other. Each of these handle shapes may be used advantageously depending on the required extraction force and geometry of the fastener/workpiece for the task at hand.

Figure 10A:
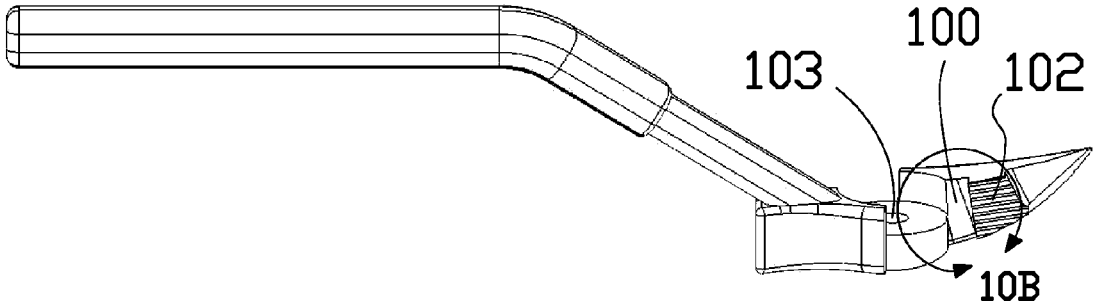
FIG. 10A shows a side view of a half of a nail extraction tool with a cutter in an embodiment of the present invention.
Figure 10B:
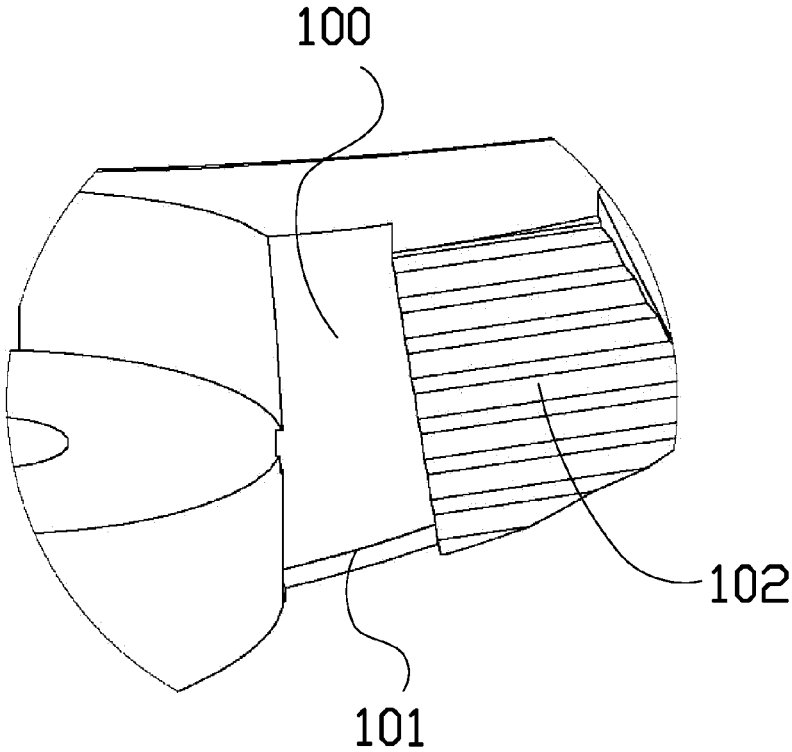
FIG. 10B shows a detailed view of the circle region 10B of FIG. 10A.

FIGS. 10A and 10B show a preferred design of a front jaw of the present invention including a cutter. The front jaw provides both a gripping feature and a cutting feature. The cutter 100 is located close to the pivot 103 to increase the cutting power of the sharp edge 101. The gripping surface 102 is located farther from the pivot 103 than the cutter to allow a greater lever action for raising a fastener gripped by the gripping surface.

Figure 12:
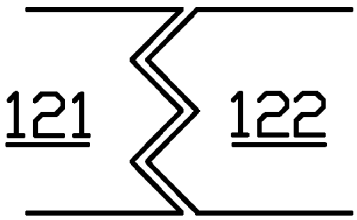
FIG. 12 shows complementary gripping surfaces of jaws of the present invention in a closed position.
Figure 13:
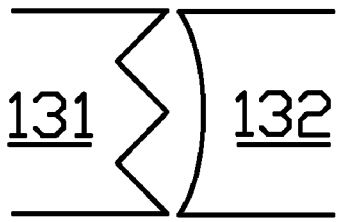
FIG. 13 shows non-complementary gripping surfaces of jaws of the present invention in a closed position.

FIGS. 12 and 13 show gripping surfaces of the jaws may have complementary profiles 121, 122 or non-complementary profiles 131, 132 within the spirit of the present invention. Either pair of profiles may be used with either a forward pair of jaws or a rearward pair of jaws.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fastener extraction tool comprising:

a) a tool head comprising:

a pivot portion;

a first half comprising:

a first forward extending portion extending longitudinally forward beyond the pivot portion, the first forward extending portion tapering in at least one dimension to a first tip to form a first sharp implement;

the first forward extending portion forming a first forward jaw having a first gripping surface formed from a substantially inward facing surface of the first forward extending portion; and a second half pivotally joined to the first half at the pivot portion, the second half comprising:

a second forward extending portion extending longitudinally forward beyond the pivot portion, the second forward extending portion tapering in at least one dimension to a second tip to form a second sharp implement;

the second forward extending portion forming a second forward jaw having a second gripping surface formed from a substantially inward facing surface of the second forward extending portion;

the tool head having a bottom surface formed by the first forward extending portion and the second forward extending portion and having a longitudinally curved profile sloping upward toward the tips from a bottom surface of the pivot portion;

b) a first handle extending rearward from the first half and having a first gripping portion; and c) a second handle extending rearward from the second half and having a second gripping portion;

wherein actuating the handles causes the pivot portion to rotate in a pivot plane and the forward jaws to open and close; and wherein a fulcrum on the bottom surfaces moves in relation to the surface of a workpiece as the tool handles are moved downward during extraction of a fastener gripped by the forward jaws, a tip plane being tangent to the bottom surfaces near the tips, the tip plane forming a leverage angle with the pivot plane.

2. The fastener extraction tool of claim 1, wherein the bottom surfaces of the forward extending portions act as a fulcrum such that pushing downward on the handles while gripping a fastener with the jaws applies a lever action to raise the jaws upward, thereby raising the fastener upward relative to the surface of the workpiece.

3. The fastener extraction tool of claim 1, wherein the bottom surfaces of the tool head slope longitudinally upward toward a rear of the tool head.

4. The fastener extraction tool of claim 1, wherein the gripping surfaces extend to the tips of the forward extending portions.

5. The fastener extraction tool of claim 4, wherein the tips of the forward extending portions meet when the tool is closed.

6. The fastener extraction tool of claim 1, wherein at least one of the gripping surfaces comprises teeth for gripping a fastener.

7. The fastener extraction tool of claim 6, wherein the teeth comprise longitudinal grooves.

8. The fastener extraction tool of claim 1, wherein the inward facing surfaces of the forward extending portions of each of the first half and the second half comprise a splayed portion near the tip that does not meet when the tool is closed, the splayed portions together defining a claw-like element for pulling a fastener.

9. The fastener extraction tool of claim 8, wherein each splayed portion includes an inward bevel on a portion of a top surface of each forward extending portion such that the inward facing surface of the splayed portion has a narrow edge for sliding under a fastener head.

10. The fastener extraction tool of claim 9, wherein each bevel is inclined toward the tip such that the edge narrows toward the tip.

11. The fastener extraction tool of claim 1 further comprising a spring that biases the two handles away from each other.

12. The fastener extraction tool of claim 1 further comprising:

a first pivot pivotally coupling the first handle to the first half at a point rearward of the pivot portion;

a second pivot, pivotally coupling the second handle to the second half at a point rearward of the pivot portion; and a third pivot pivotally coupling the handles together at a point forward of the first pivot and the second pivot;

wherein moving the first handle and the second handle toward one another causes the forward jaws to close with compound leverage.

13. The fastener extraction tool of claim 1 further comprising at least one striking surface located on the tool facing rearward such that a striking force applied to the striking surface drives the tips under a fastener embedded in a surface.

14. The fastener extraction tool of claim 1, wherein the pair of jaws does not include a cutter.

15. The fastener extraction tool of claim 1 further comprising a rearward pair of gripping jaws comprising:

i) a first rearward extending portion of the first half of the tool head extending longitudinally rearward from the pivot portion, a first gripping surface being formed from a substantially inward facing surface of the first rearward extending portion; and ii) a second rearward extending portion of the second half of the tool head extending rearward from the pivot portion, a second gripping surface being formed from a substantially inward facing surface of the second rearward extending portion.

16. The fastener extraction tool of claim 1, wherein at least one of the handles terminates in a flat chisel-type end for prying building materials apart.

17. The fastener extraction tool of claim 1 further comprising a cutter formed in the forward extending portion of the tool head.

18. The fastener extraction tool of claim 1, wherein the gripping portions are offset above the pivot plane.

19. A fastener extraction tool comprising:

a) a tool head comprising:

a pivot portion a first half comprising:

a first forward extending portion extending longitudinally forward beyond the pivot portion;

the first forward extending portion forming a first forward jaw having a first gripping surface formed from a substantially inward facing surface of the first forward extending portion; and a second half pivotally joined to the first half at the pivot portion, the second half comprising:

a second forward extending portion extending longitudinally forward beyond the pivot portion;

the second forward extending portion forming a second forward jaw having a second gripping surface formed from a substantially inward facing surface of the second forward extending portion;

the tool head having a bottom surface formed by the first forward extending portion and the second forward extending portion and having a longitudinally curved profile sloping upward from a bottom surface of the pivot portion;

b) a first handle extending rearward from the first half and having a first gripping portion; and c) a second handle extending rearward from the second half and having a second gripping portion;

wherein actuating the handles causes the pivot portion to rotate in a pivot plane and the forward jaws to open and close; and wherein a fulcrum on the bottom surfaces moves in relation to the surface of a workpiece as the tool handles are moved downward during extraction of a fastener gripped by the forward jaws.

20. A fastener extraction tool comprising:

a) a tool head comprising a forward extending portion tapering in at least one dimension to a tip to form a sharp implement, the tool head having a bottom surface having a longitudinally curved profile sloping upward from the bottom of the tool head toward the tip;

b) at least one handle extending rearward from the tool head and comprising a gripping portion; and c) a striking surface facing rearward such that a striking force applied to the striking surface drives the tip under a fastener embedded in a surface.

21. A fastener extraction tool comprising:

a) a tool head comprising:

a pivot portion;

a first half comprising:

a first rearward extending portion extending longitudinally rearward beyond the pivot portion, the first rearward extending portion forming a first rearward jaw having a first gripping surface formed from a substantially inward facing surface of the first rearward extending portion; and a second half pivotally joined to the first half at the pivot portion, the second half comprising:

forward extending portion extending longitudinally forward beyond the pivot portion; and a second rearward extending portion extending longitudinally rearward beyond the pivot portion, the second rearward extending portion forming a second rearward jaw having a second gripping surface formed from a substantially inward facing surface of the second rearward extending portion;

the tool head having a bottom surface formed by the forward extending portion and having a longitudinally curved profile sloping upward from a bottom surface of the pivot portion;

b) a first handle extending rearward from the first half and having a first gripping portion; and c) a second handle extending rearward from the second half and having a second gripping portion;

wherein actuating the handles causes the pivot portion to rotate in a pivot plane and the rearward jaws to open and close;

wherein applying an upward force to the handles with a fastener in the rearward jaws, such that the tool pivots about a fulcrum under the tool head contacting a surface of a material in which the fastener is embedded, applies a lever action to raise the fastener with respect to the surface of the material.

* * * * *